US005319392A

United States Patent [19]

Durst et al.

[11] Patent Number: 5,319,392

[45] Date of Patent: Jun. 7, 1994

[54] THERMAL PRINTING APPARATUS HAVING VARIABLE SPEED PRINTING

[75] Inventors: William B. Durst, Lebanon, Ohio; Charles G. Parks, Jr., Stamford, Conn.; Lorraine T. Porter, Dayton, Ohio

[73] Assignee: Pitney Bowes Inc., Stamford, Conn.

[21] Appl. No.: 993,981

[22] Filed: Dec. 21, 1992

[51] Int. Cl.[5] ..... B41J 2/325

[52] U.S. Cl. ..... 346/76 PH; 346/134

[58] Field of Search ..... 400/207, 120; 346/76 PH, 134

[56] References Cited

U.S. PATENT DOCUMENTS 4,588,996 5/1986 Ross et al. ..... 346/76 PH 5,064,301 11/1991 Nakamura et al. ..... 400/120

*Primary Examiner*—Benjamin R. Fuller

*Assistant Examiner*—Huan Tran

*Attorney, Agent, or Firm*—Charles G. Parks, Jr.; Melvin J. Scolnick

[57] ABSTRACT

A thermal printing postage meter comprising a base supporting a registration wall, a print deck. The registration wall supports a detachable mounted thermal ribbon cassette and a thermal print head. The thermal print head is mounted to the registration wall to extend over the deck to define a print station. A platen drive assembly is mounted to the base for biasing an envelope against the thermal print head and causing the envelope to traverse the thermal print head during a print cycle of the thermal meter under the influence of a drive motor responsive to a micro controller. The micro controller has a plurality of switches mounted to the registration wall of the postage meter. The cassette is comprised of a housing formed by a front and rear wall maintained in spaced apart relationship by a plurality of side walls. The rear wall of the housing includes a slot having an outwardly extending pin slidably mounted in the slot. The switches are mounted within an opening in the registration such that mounting of the cassette housing to the registration wall cause the pin to contact one of the switches depending on the position location of the pin in the slot. The micro controller is programmed to operate the print cycle speed at one of the speeds in response to which one of the switches actuated by the actuation means.

6 Claims, 6 Drawing Sheets

THERMAL PRINTING APPARATUS HAVING VARIABLE SPEED PRINTING

BACKGROUND OF THE INVENTION

The present invention relates to a thermal printing apparatus for printing on flat materials and, more particular, to a postage meter utilizing thermal printing of a postage indicia on envelopes.

Conventionally, a thermal printing apparatus of the type used to print postage includes a deck with an aligned registration wall. Mounted to the registration wall is a thermal print head and transfer ribbon cassette. The mounting of the thermal print head and transfer ribbon cassette are aligned to produce a printed image on a envelope properly positioned under the control of a micro control system.

Conventionally, a thermal printing postage metering apparatus operates at a single operating speed which restricts the envelope paper stock quality which may be processed by the thermal postage meter. It is known in the art of thermal printing that thermal printing cycle speeds are set to operate at a single cycle speed optimized to provide a specified print quality as a function of paper stock. Therefore, with respect to postage meter print operation where print quality is required to be relatively high to prevent fraud, the envelope paper stock which may be processed at the prescribed print cycle speed is limited in order to preserve print quality.

SUMMARY OF THE INVENTION

It is the object of the present invention to present a thermal printing postage meter having variable printing speed capability.

A thermal printing postage meter includes a thermal print head mounted to the registration wall of a support platform. The thermal print head is comprised of a linear array of thermal heating elements bonded to an elongated convexed raise formed on the print side of a ceramic substrate. The array of heating elements is located central to the raise. A near edge thermal print head is employed which refers to the position of the thermal heating element array relative to the substrate forward edge. The substrate is mounted to the registration wall at an angle of approximately 10° degrees relative to the transport deck of the support platform.

A platen roller which is under the influence of a drive motor is aligned opposite to the thermal print head. The drive motor is responsive to a micro control system. A thermal ribbon cassette is detachably mounted to the registration wall such that a portion of the cassette thermal transfer ribbon is positioned opposite the thermal print head ink side down. The platen is biased to urge the printing area of the envelope against the cassette ribbon with the thermal print head providing a backing. The envelope is synchronously transported past the thermal print head heat element array actuated by the micro controller.

The ink cassette is constructed to accommodate either the polymer or wax based ink solution. The base cassette is constructed to utilize a conventional supply spool and a take-up spool rotatively mounted to the cassette housing. The ink transfer ribbon is threaded between a plurality of posts from the supply spool to the take-up spool passing through a print opening. The cassette opening is sized to receive the angled thermal print head positioning the transfer ribbon to be opposite the thermal heat element. One of the cassette post, print post, located just downstream of the thermal print head is positionable between a first and second position. The effect of positioning the print post alters the angle assumed between the print head and the print post. In a first position of the print post, the cassette is particularly suited for containing a wax ink formulation. The print post is set at this position causing the transfer ribbon to extend horizontal and parallel to the deck between the print head and the print post for a distance of approximate 2.5 inches. In a second position of the print post, the cassette construction is particularly suited for containing a polymer ink formulation, the print post is set at a location such that the transfer ribbon assumes a 10° degrees immediately subsequent to the thermal print head.

The cassette housing further includes a positionable pin. In the first position the pin contacts a first switch which is in communication with the micro controller, thereby informing the micro controller that a polymer based ink formulation is in use. In the second position, the pin contacts a second switch which is in communication with the micro controller, thereby informing the micro controller that a wax based ink formulation is in use. With this information the micro controller is programmed to adjust the printing speed to optimize print quality.

DETAILED DESCRIPTION OF THE PREFERRED EMBODIMENT

Figure 1:
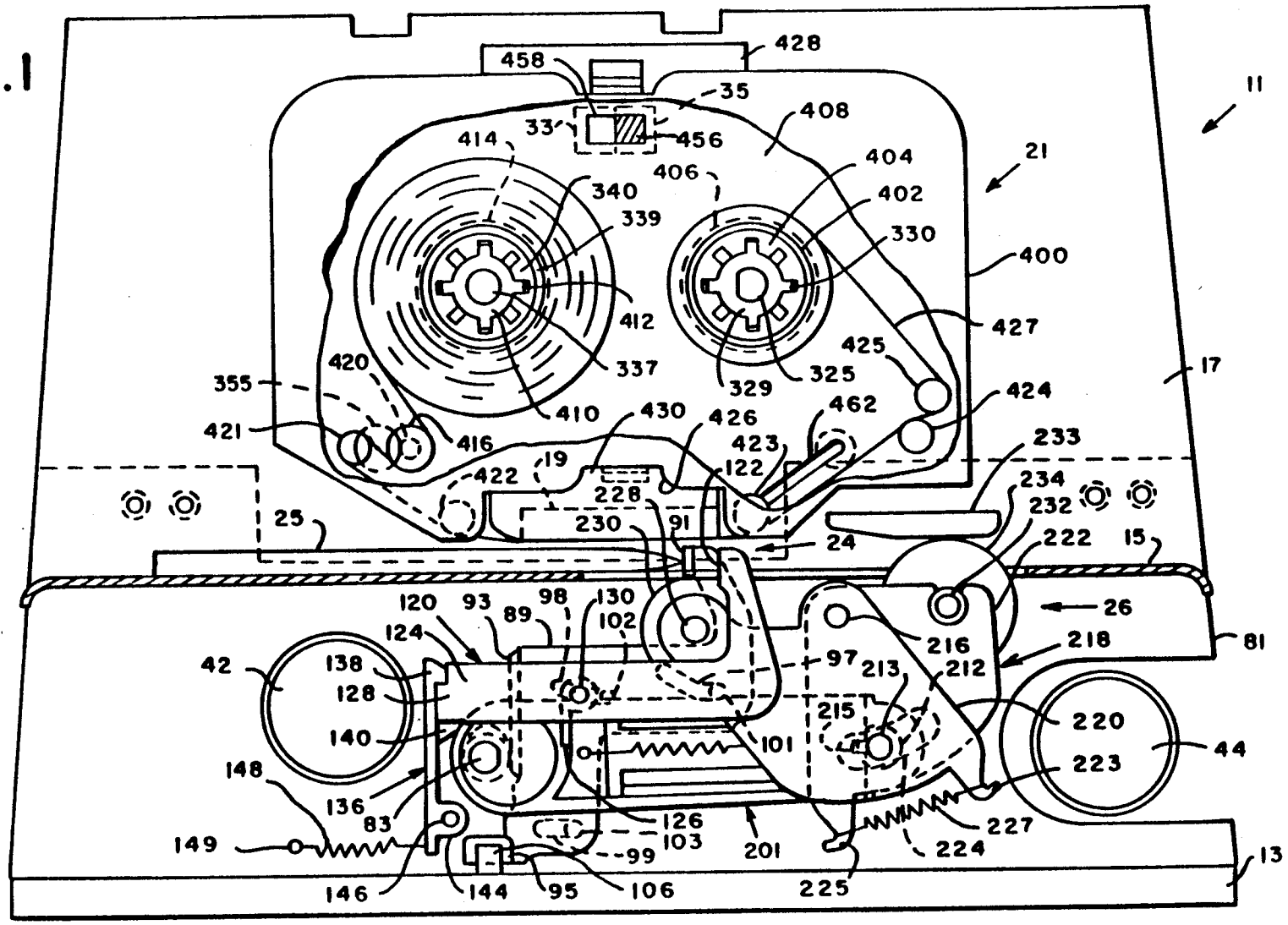
FIG. 1 is a frontal view of a thermal postage meter and ribbon cassette in accordance with the present invention.

Referring to FIG. 1, a thermal postage meter, generally indicated as 11, includes a base 13 which supports horizontally an elongated deck 15. The base 13 also supports a registration wall 17, by any conventional means. The registration wall 17 extends vertically upward from the deck 15 along the back side of the deck 15. The registration wall is aligned along the back length of the deck 15. A thermal print head bracket 19 is fixably mounted, by any conventional means, to the registration wall 17. The thermal print bracket 19 has mounted, in a manner subsequently described, a thermal print head 20 at an angle of approximately 10° to extend over the deck 15 in a manner to be described subsequently.

In the preferred postage meter embodiment, mounted in the base 13 is a position sensing arrangement generally indicated as 24, for sensing the position of an envelope 25 transported along the deck 15 by a platen roller assembly, generally indicated as 26. A more detailed description of a suitable embodiment for a thermal postage particularly suited for the present invention is described in U.S. patent application Ser. Nos. 07/950,341 and 07/950,353, both filed on Sep. 24, 1992.

Figure 2:
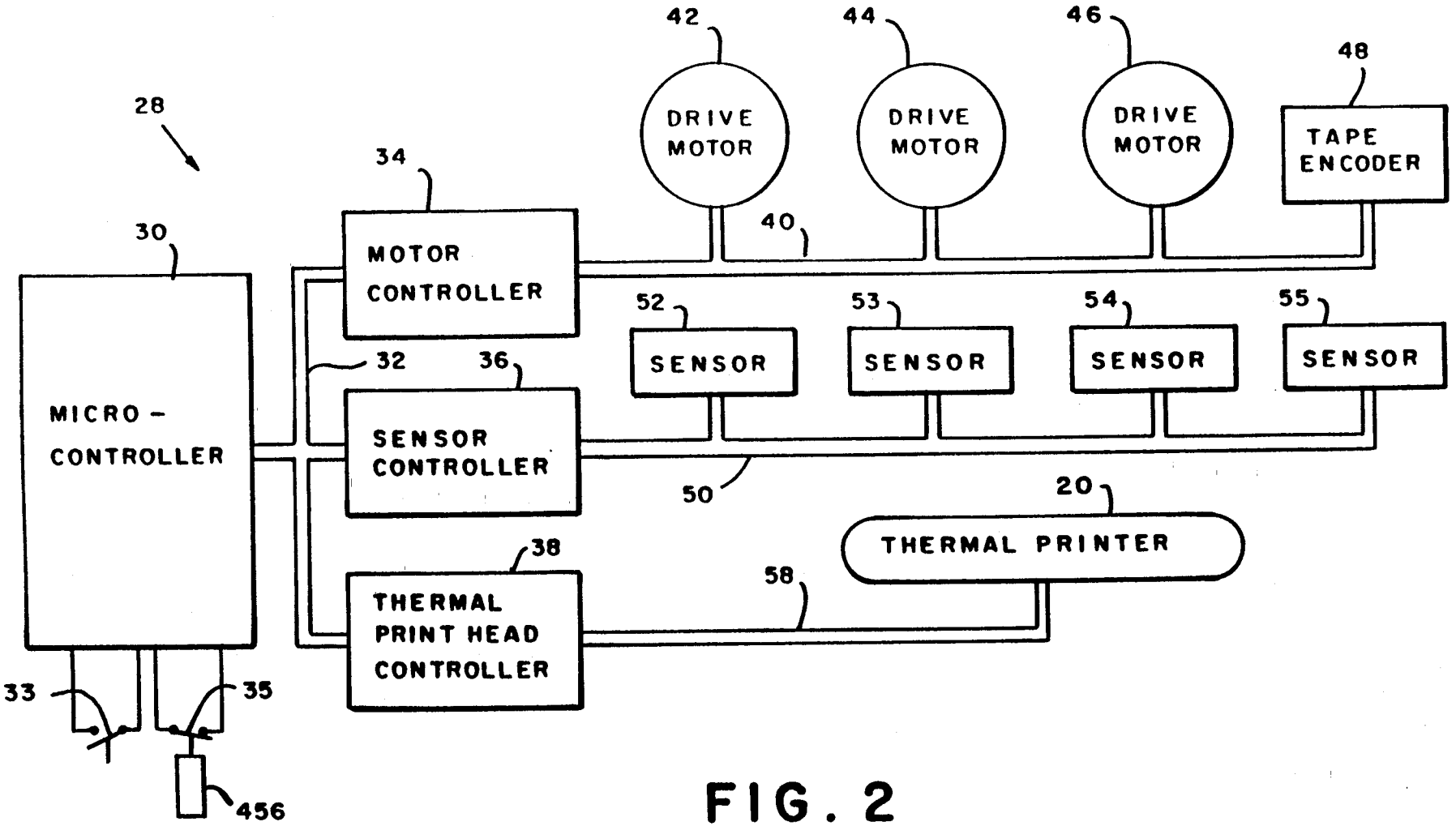
FIG. 2 is a schematic of a micro controller in accordance with the present invention.

Referring to FIGS. 1 and 2, the thermal printing meter 11 is under the influence of a system micro controller, generally indicated as 28. The micro controller system 28 is comprised of a programmable micro controller 30 of any suitable conventional design, which is in bus 32 communication with a motor controller 34, a sensor controller 36, and the thermal print head controller 38. The motor controller 34, sensor controller 36 and thermal print head controller 38 may be of any suitable conventional design. The motor controller 34 is in motor bus 40 communication with a plurality of drive motors 42, 44 and 46. The motor control bus 40 also communicates the motor controller 34 to a tape encoder 48. The sensor controller 36 is in sensor bus 50 communication with a plurality of sensors 52–55 and the thermal printer controller 38 is in print head bus 58 communication with the thermal print head 20. A first switch 33 and a second switch 35 are in line communication with respective input pins of the micro controller 30.

Figure 3:
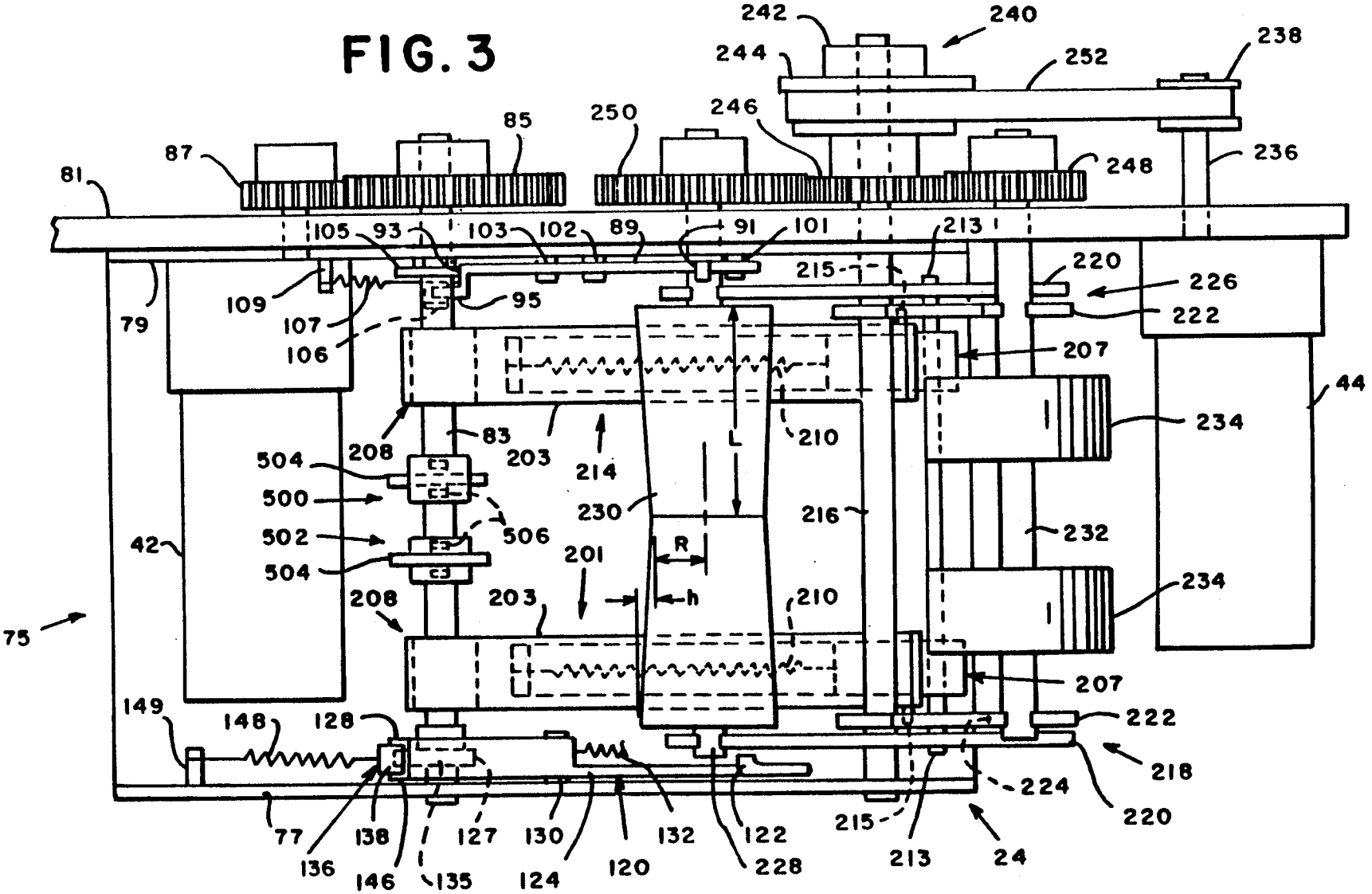
FIG. 3 is a sectioned top view of the thermal postage meter in accordance with the present invention.

Referring to FIGS. 1 and 3, the position sensing assembly 24 is comprised of a U-shaped support bracket 75 mounted to the base 13. The U-shaped support bracket 75 has a bracket forward wall 77 and a rear wall 79. Preferably, the bracket 75 is mounted to a base support wall 81 by any conventional means.

A shaft 83 is rotatively mounted to extend between the bracket walls 77 and 79 by any conventional means such as by a bearing assembly. A drive gear 85 is fixably mounted to the shaft 83 at one end. The motor 42 has a output gear 87 which is in constant mesh with the drive gear 85 for causing the shaft 83 to rotate under the influence of the motor 42. A position lever 89 which includes a envelope facing surface 91 is slidably mounted on the rear wall 79 of the bracket 75. A cam 105 is eccentrically mounted to the shaft 83 such that the camming periphery of the cam 105 is opposite the camming surface 93 of the position lever 89. A spring 107 is detachably mounted to the position lever at one end and to a formed tab 109 in the rear wall 79 at the other end. The spring biases the position lever 89 such that the camming surface 93 is biased against the can surface of cam 105.

Mounted to the forward bracket wall 77 is an envelope stop lever 120. The stop lever 120 is pivotally mounted on a hub 130 which is formed in the forward bracket wall 77. A spring 132 which has one end attachably mounted to a tab 134 formed on the rearward bracket wall 77 and the other end attachably mounted to the collared tab 126 biases the camming surface 127 against the can 105. A locking lever 136 which includes a locking tab 138 and 140 for securing the locking tab 128 of the envelope stop lever 20 between the locking tabs 138 and 140 of the locking lever 136. The locking lever 136 also includes a camming surface opposite the cam 105. A spring 148 which is detachably mounted at one end to a tab 149 and at its other end to the envelope stop lever 120 is mounted for biasing the locking lever 136 in the direction of the cam 105.

Still referring to FIGS. 1 and 3, the platen roller assembly 26 includes a linking arm assembly 201 comprising a first link section 203 and second link section 207. One end of the first linking section 208 is eccentrically mounted around the shaft 83. A spring 210 having its respective ends detachably mounted in the first and second sections of the linking arm 203 and 207, respectively, biases the second section 207 within the receiving channel of the first link section 203. The exposed end of the second section 207 includes a hub 212. A second linking arm assembly 214 is constructed identical to the linking assembly 201 and is eccentrically mounted in cooperative alignment with the linking arm assembly 201 on the shaft 83.

A pivot link assembly, generally indicated as 218, is mounted to a shaft 216 which is rotatively mounted between the rearward and forward bracket walls 77 and 79, respectively. The pivot link assembly 218 includes a first link plate 220 pivotally mounted around shaft 216 at one point and pivotally mounted around the hub 212 at another point. A second link plate 222 is pivotally mounted around the shaft 216 at one point and includes a slot 224 wherein the hub 212 rides therein. A spring hook 223 is formed in the first link plate 220 and a spring hook 225 is formed in the second link plate 222.

A spring 227 has its respective ends fastened around the respective spring hooks 223 and 225 in a conventional manner. A second pivot link assembly 226, identical to the pivot link assembly 218, is pivotally mounted to the shaft 216 in spaced apart relationship to the pivot link assembly 218. A platen module 228 is rotatively mounted by any conventional means to the link plates 220 of the respective pivot link assemblies, 218 and 226. A platen roller 230 is fixably mounted around the platen roller shaft 228, between the pivot link assemblies, 218 and 226.

A pressure roller shaft 232 is rotatively mounted by any conventional means to the link plates 222 of the respective pivot link assemblies 218 and 226. Pressure rollers 234 are fixably mounted around the pressure roller shaft 232 in spaced apart relationship. The pressure rollers 234 are aligned generally opposite a backing member fixably mounted on the registration wall 17 and extending laterally therefrom. A drive shaft 236 having a spool 238 fixably mounted to one end is responsive to the motor 44. A spool gear arrangement 240 which includes a hub 242 rotatively mounted around the shaft 216, a spool 244 fixably mounted to the hub 242 and a gear 246 also fixably mounted to the hub 242. A gear 248 is fixably mounted to the shaft 232 and a gear 250 is fixably mounted around the shaft 228. The gears 246 is in constant mesh with gear 248 and 240, and an endless belt 252 extends around the spools 238 and 244.

Figure 4:
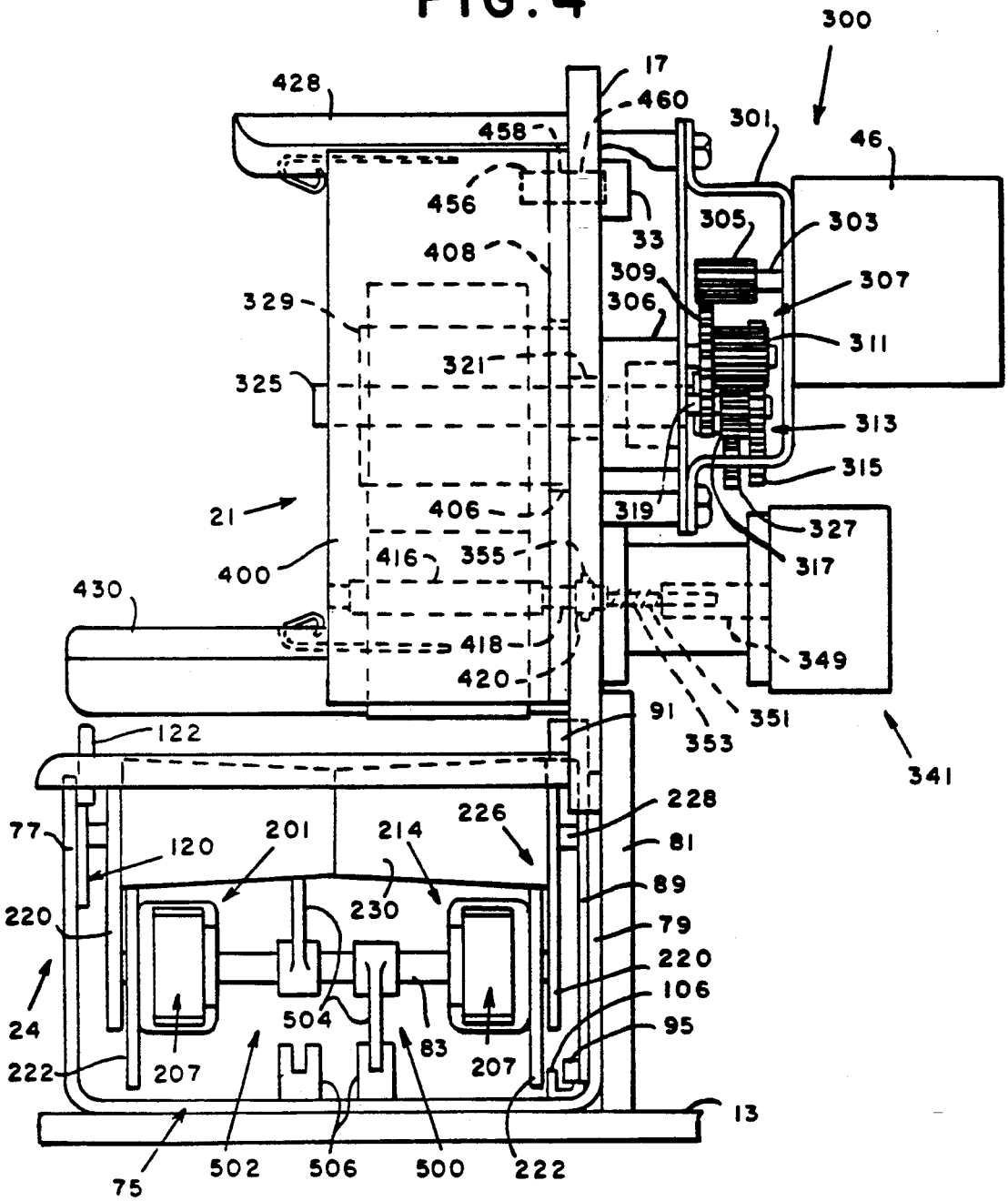
FIG. 4 is a sectioned end view of the thermal postage meter in accordance with the present invention.

Referring to FIGS. 1 and 4, a thermal drive cassette assembly, generally indicated as 300, is comprised of a mounting platform 301 of any suitable construction. The mounting platform 301 is fixably mounted, by any conventional means, to the back side of the registration wall 17. The tape motor 46 is fixably mounted to the mounting platform 301, by any suitable conventional means. The output shaft 303 of the drive motor 46 has a drive gear 305 fixably mounted to the output shaft 303 of the drive motor 46. A conventional double gear set 307 having a first gear 309 in constant mesh with the drive gear 305 and a second gear 311 rotatively mounted to the back side of the registration wall 17. A conventional double idle gear set 313 having first gear 315 in constant mesh with the gear 311 and a second gear 317 is rotatively mounted by any conventional means to a gear hub 319. The gear hub 319 is fixably mounted to the mounting platform 301 by any conventional means and rotatively supports the idle gear set 313 by any suitable conventional means. A registration wall aperture 312 is formed in the registration wall 17. A conventional bearing hub assembly 323 is fixably mounted to the back side of the registration wall 17 aligned to the aperture 321. A tape drive shaft 325 extends through the aperture 321 rotatively supported by the bearing hub assembly 323. A gear 327 is fixably mounted by any conventional means to one end of the tape drive shaft 325 in constant mesh with the gear 317. A tape take-up spool 329 is fixably mounted by any conventional means around a portion of the tape drive shaft 325.

A tape supply assembly, generally indicated as 331, is mounted to the back side of the registration wall 17 aligned to a registration wall aperture 333. The tape supply assembly 331 includes a conventional one way friction clutch and shaft assembly 335 of any suitable construction fixably mounted to the back side of the registration wall 17 aligned to the aperture 333. The assembly 335 includes an supply shaft 337 extending through the aperture 333. A tape supply spool 339 is fixably mounted by any conventional means around a portion of the supply shaft 337. Mounted to the back side of the registration wall 17 aligned to an aperture in the registration wall 17 are switches 33 and 35.

An encoding assembly, generally indicated as 341, is fixably mounted to a mounting spindle 343 which is fixably mounted to the back side of the registration wall 17, by any suitable conventional means, aligned to a registration wall aperture 345. The encoding assembly 341 includes collar 347 and a input shaft 349. A mating male shaft 351 is received by the shaft 349 such that the male shaft 351 can experience limited axially displacement within the shaft 349 and such that the male shaft rotatively drive the shaft 349 such as by any suitable conventional mating longitudinal gears arrangement or single shaft arrangement. A spring 353 is placed around the shaft 351 and an end cap gear 355 is fixably mounted by any conventional means to the shaft 351 within the aperture 345.

The tape cassette 21 is comprised of a cassette housing 400 having a take-up spool 402. The take-up spool 402 has formed axial extending gear teeth 404. The take-up spool 402 is rotatively mounted by suitable conventional means in the cassette housing 400 to be axially aligned to a opening 406 in the rear wall 408 of the housing 400. The gear teeth 404 of the take-up spool 402 are configured to be mating to axial gear teeth 330 formed on the periphery of the tape take-up spool 329. In like manner to take-up spool 402, the cassette housing includes supply spool 410 having axial extending gear teeth 412 rotatively mounted to the rear wall 408 aligned to an opening 414 in the rear wall 408. The gear teeth 412 are configured to be mating to axial gear teeth 340 formed on the periphery of the tape supply spool 339. An encoding post 416 is rotatively mounted in the cassette rear wall 408, by any suitable conventional means, having a short shaft 418 extending through the rear wall 408 and into the aperture 345 in the registration wall 17. A gear 420 is fixably mounted to one end of the short shaft 418 to be in constant mesh with the gear 355 of the encoding assembly 341. A plurality drag post 421, 422, 423, 424 and 425 are strategically mounted fixably by any conventional means to the cassette rear wall 408. The cassette housing 400 further has a cassette opening 426 through which the print head 19 extends such that the thermal ribbon 427 extends from the supply 339 to the take-up spool 404 being threaded between the post 421, post 422, through the opening 426 below the print head 19 and between the post 423, 424 and 425. The cassette is detachably mounted by any conventional means such as between an upper clamp 428 and lower clamp 430 which extend from the registration wall 17. In the preferred embodiment, the following dimensions are observed within the thermal ribbon cassette.

Figure 5:
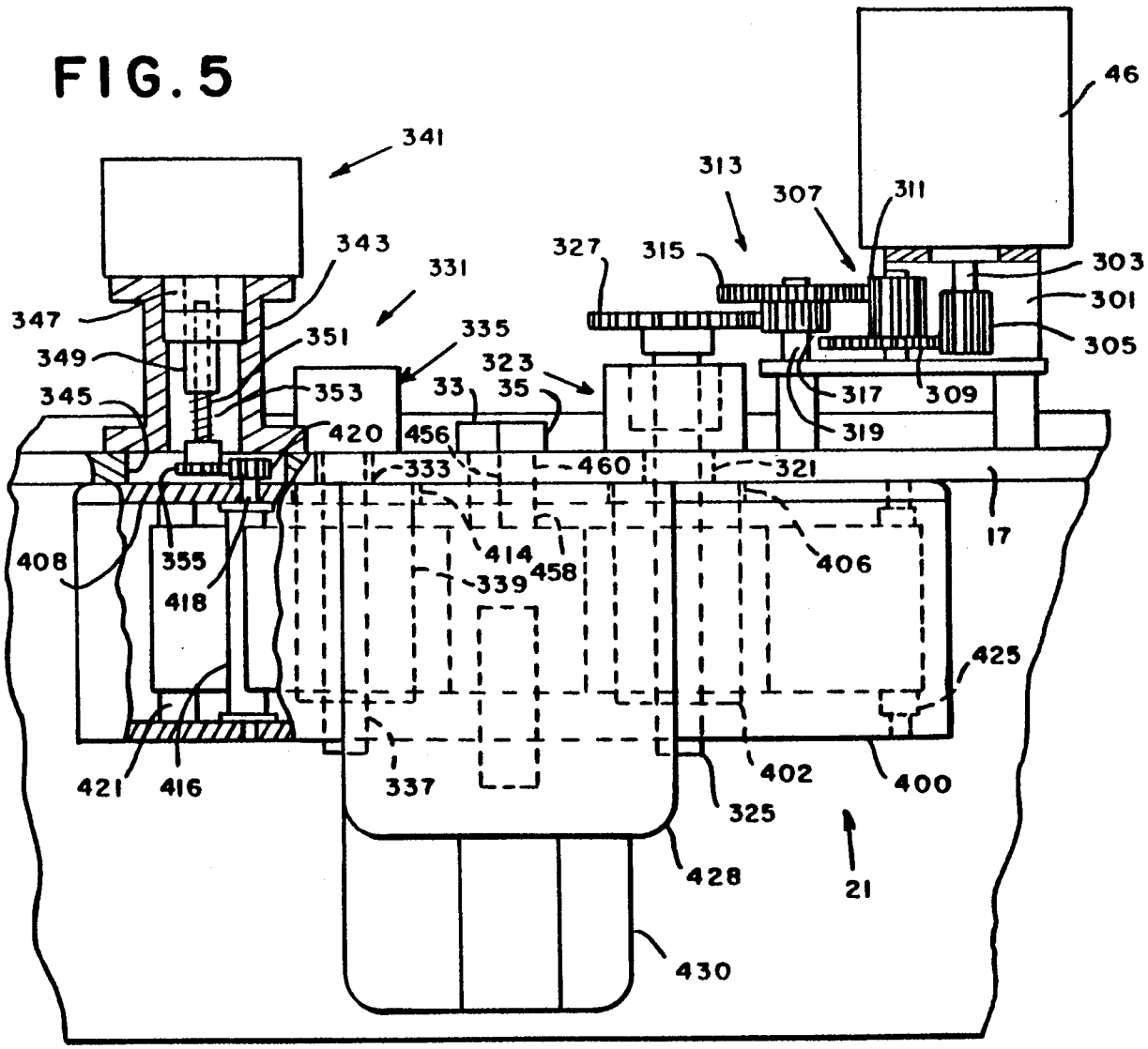
Figure 6:
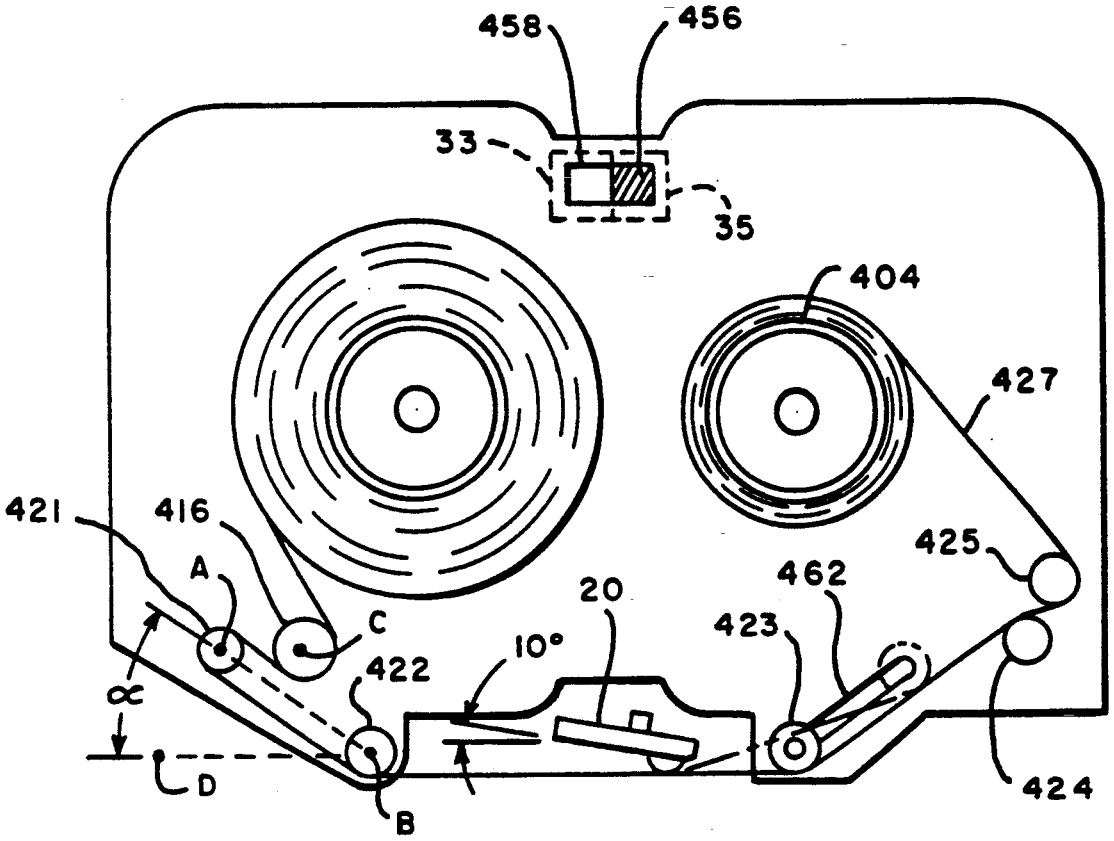
FIG. 6 is a frontal view of a first thermal ribbon cassette in accordance with the present invention.

| | |
|---|---|
| encoder post | polyurethane having a coefficient of friction of 1.5 or greater, |
| first drag post | surface coefficient of fiction of between 0.2 and 0.5, |
| feed post | a surface coefficient of friction of between 0.2 and 0.5. |

angle between first drag post and encoder post is set at a horizontal angle between 0 degrees and 5 degrees angle between feed post and first drag post is set at between 30 degrees and 45 degrees Referring particularly to FIGS. 1 and 5, the function of the thermal postage meter 11 is to accept an envelope 25, print an indicia using thermal transfer print technology, and eject the envelope 25 from the printer. The feed direction of the printer is from left to right. The function of the platen roller 230 is to feed the envelope at a uniform rate and to supply the print head pressure needed. to transfer the thermal ink from the ribbon. As the platen 230 feeds the envelope through the print nip, it also feeds the thermal transfer ribbon. Therefore, use of the platen roller 230 for ejection would lead to wasted ribbon. A separate ejection roller 234 is used to feed the envelope out of the printer after printing.

The thermal transfer ribbon feeds around a urethane wrapped encoder roller 416 inside the cassette (refer to FIG. 5). As the ribbon feeds, the friction of the ribbon against the encoder roller 416 causes it to turn. The encoder roller gear 420 which protrudes from the back side of the cassette and couples with a mating gear 355 in the printer. The mating gear 355 turns an optical encoder 341 which is used to monitor ribbon motion.

Once the platen roller 230 has fully engaged the envelope 25, the motor 44 and the ribbon drive motor 46 are started. Note that the motor 44 turns both the platen roller 230 and the ejection rollers 234. However, the ejection roller 234 are not in the supply path so it has no affect on the envelope 25. The envelope 25 and cassette ribbon begin to feed and are brought up to speed. Printing then starts by loading data to the print head at a constant rate from the micro controller 30 through the print head controller 38. The speed is monitored and controlled through the encoder (not shown) on the motor 44. In the preferred embodiment of the present invention, the printing operation takes about 525 mS for a polymer based ink transfer ribbon formulations and at 425 mS for wax based ink transfer ribbon. Polymer ribbons require more energy than wax ribbons to transfer an image. Lowering the print speed reduces the energy duty cycle to the printhead, extending the life of the printhead.

While printing, the ribbon is driven through the print nip by the notion of the envelope 25. The ribbon take-up motor 46 winds up the ribbon on the take-up core and provides even tension without pulling the ribbon through the print nip. In order to provide the even tension desired, the back EMF of the motor 46 is monitored. Changes in the back EMF indicate quantity of ribbon and the ribbon drive is modified accordingly. In addition, a sharp change in the back EMF of the motor indicates that the ribbon is broken after the print head or the ribbon has stopped.

Tension on the supply side of the print nip must also be maintained. The ribbon is fed through a series of posts 416, 421, 422, 423, 424 and 425 (post 416 being the encoder roller which provides drag to the ribbon through the friction of the ribbon against the posts). A light clutch load is provided by the one way clutch 335 on the ribbon supply core to provide tighter wrap of the ribbon around the post. The ribbon encoder 341 is turned by the friction of the ribbon moving past the roller 416. The encoder motion is monitored by the micro controller 30 to determined if the ribbon breaks before reaching the print head or if the ribbon runs out. In addition, the encoder can be used to monitor the speed of the ribbon, and therefore the envelope, through the print nip.

When printing has been completed, the shaft 83 rotates 180 degrees back to its original home position. The drive link 201 and 214 becomes a solid assembly which pushes the ejection roller 234 against the envelope 25. Since a lighter load is needed for ejection than for printing, the spring 227 becomes the only active spring. The motor 44 continues to drive both rollers 230 and 234. At this point, however; the platen roller 230 becomes inactive because it is below the feed deck. At the same time, the ribbon motor 46 is stopped. When the ejection roller 234 engages, it feeds the envelope 25 from the printer at 2 to 3 times the print speed in the preferred. Once the envelope 25 clears the print nip, the stop and trip levers 120 and 89, respectively, return to their home position. The drive motor 44 is stopped and the process is complete.

The thermal printing head bracket 19 has secured therein by any suitable conventional manner the thermal print head 20 such as within sleeves 450. The thermal print head 20 is comprised of a linear array of thermal heating elements 452 bonded to an elongated convexed raise 454 which raise is composed of a ceramic material to provide a ceramic substrate. The array of heating elements 452 is located central to the ceramic raise 454. A near edge thermal print head is employed which is descriptive of the location to position of the thermal heating element array 454 to the lead edge of the thermal print head 20. As previously noted the thermal print head 20 is mounted to the registration wall at an angle of approximately 10° degrees relative to the transport deck of the support platform. Referring also to FIG. 4, the back wall 408 of the cassette 21 also includes a slot 458 in which a pin 456 is slidably mounted by any conventional means such that the pin 456 can be slidably positioned in a first or second position. The pin 456 extends through a aperture 460 in the registration wall 17 to contact either the first switch 33 in the first pin 456 position or the second switch 35 in the second pin 456 position to actuate the respective switch 33 or 35. The back wall 408 of the cassette 21 also includes a slot 462 in which the post 423 is positionable in a first position or a second position, by any suitable conventional means, to effect a change in the trajectory of the transfer ribbon 427 from the print head 20.

In operation, when the cassette 21 houses a polymer based ink formulation the post 423 is positioned in the first position and the pin 456 is in the first position. By so positioning, the pin 456 contact between the envelope 25 in the print area is maintained for a sufficient time which has been shown to improve ink transfer. The position of the pin activates switch 33 which informs the micro controller 30 that a polymer ink formulation is in use. The micro controller 30 is programmed to operate the print process as an optimum speed for polymer ink transfer. When the cassette 21 houses a wax based ink formulation, the post 423 is positioned to the second position and the pin 456 in the second position. By so positioning the pin 456, contact between the envelope 25 in the print area is terminated immediately after printing which has been shown to improve the ink transfer process.

The above description describes the preferred embodiment of the invention and should not be viewed as limiting. The scope of the invention is set forth in the appendix claims.

What is claimed is:

1. An improved thermal printing apparatus, said printing apparatus having a base supporting a registration wall, said registration wall supporting a thermal ribbon cassette, a print deck, a thermal print head mounted to the registration wall and extending over the deck to define a print station, a platen drive assembly is mounted in said base for biasing an envelope against the thermal print head and causing the envelope to traverse the thermal print head during a print cycle of the thermal printing apparatus having a drive motor responsive to a micro controller, the improvement comprising; said micro controller being programmable and programmed to operate said drive motor of said platen assembly at a plurality of operating speeds, said micro controller being further programmed to synchronously actuate said thermal print head, selection means for selectively causing said micro controller to select one of a plurality of print cycle speeds.

2. An improved thermal printing apparatus as claimed in claim 1 wherein said selection means comprises:

said micro controller having a plurality of switches mounted in said printing apparatus;

said thermal ribbon cassette having actuation means positionable to actuate one of said plurality switches when said thermal ribbon cassette is mounted to said registration wall;

said micro controller to operate said platen roller assembly at one of a plurality of spaces in response to which one of said switches actuated by said actuation means.

3. An improved thermal printing apparatus as claimed in claim 2 wherein said actuation of said thermal ribbon cassette includes:

said cassette having a housing formed by a front and rear wall maintained in spaced apart relationship by a plurality of side walls, said rear wall of said housing having a slot;

a outwardly extending pin slidably mounted in said slot;

said plurality of switches being mounted within an opening in said registration wall such that mounting of said cassette housing to said registration wall causes said pin to contact one of said switches depending on the position location of said pin in said slot.

4. An improved thermal printing apparatus as claimed in claim 2 wherein said printing apparatus is a postage meter.

5. An improved thermal printing apparatus as claimed in claim 3 wherein said printing apparatus is a postage meter.

6. An improved thermal printing apparatus, said printing apparatus having a base supporting a registration wall;

said registration wall supporting a thermal ribbon cassette, a print deck, a thermal print head mounted to the registration wall and extending over the deck to define a print station;

a platen assembly is mounted in said base for biasing an envelope against the thermal print head;

drive means for causing an envelope to traverse the thermal print head during a print cycle of the thermal printing apparatus having a drive motor responsive to a micro controller;

the improvement comprising:

said micro controller being programmable and programmed to operate said drive motor at a plurality of operating speeds, said micro controller being further programmed to synchronously actuate said thermal print head, selection means for selectively causing said micro controller to select one of a plurality of print cycle speeds.

* * * * *